US005211152A

United States Patent [19]

Alexandrov

[11] Patent Number: 5,211,152

[45] Date of Patent: May 18, 1993

[54] DISTRIBUTORLESS IGNITION SYSTEM

[76] Inventor: Felix Alexandrov, 405 N. 5-th St., Apt. 204, Mankato, Mich. 56001-4411

[21] Appl. No.: 823,144

[22] Filed: Jan. 21, 1992

[51] Int. Cl.[5] ..... F02P 3/04

[52] U.S. Cl. ..... 123/620; 123/643; 123/656

[58] Field of Search ..... 123/606, 620, 621, 634, 123/635, 636, 637, 643, 656

[56] References Cited

U.S. PATENT DOCUMENTS

| | | | |
|---|---|---|---|
| 4,326,493 | 4/1982 | Merrick | 123/620 X |
| 4,356,807 | 11/1982 | Tokura et al. | 123/606 |
| 4,462,380 | 7/1984 | Asik | 123/620 |
| 4,510,915 | 4/1985 | Ishikawa et al. | 123/620 |
| 4,599,985 | 7/1986 | Betz | 123/622 |
| 4,702,221 | 10/1987 | Tokura et al. | 123/606 |
| 4,711,227 | 12/1987 | Li et al. | 123/643 |
| 4,834,056 | 5/1989 | Kawai | 123/635 |
| 4,841,944 | 6/1989 | Maeda et al. | 123/620 X |
| 4,892,073 | 1/1990 | Yamamoto et al. | 123/417 |
| 4,938,200 | 7/1990 | Iwasaki | 123/620 |
| 4,947,821 | 8/1990 | Somiya | 123/606 |
| 4,978,526 | 3/1991 | Gokhale | 123/598 |
| 4,996,967 | 5/1991 | Rosswurm et al. | 123/598 |
| 5,009,213 | 4/1991 | Di Nunzio et al. | 123/620 |

OTHER PUBLICATIONS

John B. Heywood, Internal Combustion Engine Fundamentals, McGraw Hill, Inc., Jan.-1988, FIG. 9-39.

*Primary Examiner*—Willis R. Wolfe

[57] ABSTRACT

Disclosed is a distributorless ignition system of inductive discharge type for internal combustion engines. This system comprises basic ignition coil means (14) for centralized supplying of inductive energy for spark plugs and trigger ignition coil means (22a, 22b, 22c and 22d) preferably disposed on spark plug heads for inducing electrical break-down across the electrodes of a spark plug. Both the basic and trigger ignition coil means are energized from a battery (10) through switching means (36a and 36b). The basic ignition coil means generates current pulses for spark plugs with respectively low voltage. The rated power of the trigger ignition coil means is provided to be much less than the same of the basic ignition coil means.

9 Claims, 7 Drawing Sheets

DISTRIBUTORLESS IGNITION SYSTEM

BACKGROUND OF THE INVENTION

1. Technical Field

This invention relates to a distributorless ignition system for internal combustion engines, and more particularly, to an inductive discharge ignition system.

2Description of Prior Art

Recently, higher ignition effect and efficiency are required from an ignition system to gain higher power and better fuel combustion from an engine of a vehicle. U.S. Pat. No. 4,462,380 (hereinafter '380 patent) issued to J. R. Asik, discloses a distributorless ignition system that uses a supplementary spark energy (SSE) module to increase ignition energy. FIG. 8A herebelow shows a block diagram of a distributorless ignition system for internal combustion engines according to the '380 patent. Two ignition coils T1 and T2 have primary windings PR1 and PR2 which are driven by ignition modules No.1 and No.2 correspondingly. Secondary windings SEC of the ignition coils T1 and T2 are coupled in series with spark plug electrodes and the SSE module. The '380 patent teaches employing a simple DC to DC converter as the SSE module. FIG. 8C shows a schematic diagram of the SSE module that converts 12 V DC to 3 kV DC. Referring to FIG. 8B for explaining the manner of the circuit, the $I_{s-p}$ current in spark plugs (SP-1, SP-2, SP-3 and SP-4) changes according to following expression (t is the time, L is inductance, $V_{s-p}$ is constant spark holding voltage between spark plug electrodes in a 'post-break-down' phase, and $V_{em}$ is a constant output voltage of the SSE module):

$$I_{s-p} = I_{s-p\,max} - \frac{V_{s-p} - V_{em}}{L}\,t \qquad (1)$$

$V_{s-p}$ depends proportionally on the distance between spark plug electrodes and may differ significantly for different cylinders of an engine. FIG. 8B shows the $I_{s-p}$ current in a spark plug with the SSE module (line I) and without it (dotted line II). The SSE module provides for an extension of ignition time that increases ignition energy of each stroke. Ignition time may be represented as follows:

$$T_i = \frac{I_{s-p\,max}\,L}{V_{s-p} - V_{em}} \qquad (2)$$

Nevertheless a need still remains for reduction of rated power and miniaturization of ignition coils, especially when said coils are disposed directly on spark plug heads. In the above mentioned ignition system reduction of inductance L (which results in reduction of energy that can be stored in the ignition coils T1 and T2) causes shortage of the ignition time $T_i$ (see expression 2). This reduction cannot be compensated for by increasing of the output $V_{em}$ voltage of the SSE module. As mentioned above, the spark holding $V_{s-p}$ voltage corresponds to spark plug gap as well as to pressure, temperature and other parameters of the fuel/air mixture in a cylinder. Because all of these parameters have tolerances , $V_{em}$ must be kept much lower than mean $V_{s-p}$ (see expression 1). Otherwise, the spark plug current $I_{s-p}$ can be excessive and, in the extreme case, continuous and uncontrollable. The use of a dummy load diminishes this defect, but is not able to eliminate it. In that way the reduction of inductive energy in above mentioned system leads to ignition unstability.

Enhancing of ignition power may be also achieved by means of high frequency sparking that is set forth in U.S. Pat. No. 4,938,200 issued to S. Iwasaki. This patent discloses a relatively high frequency ignition device which comprises a basic ignition coil for all spark plugs, and a high voltage transformer for each spark plug. This transformer is magnetized periodically in one direction for several times during an ignition interval. The first magnetization pulse should have a duration that is sufficient to ensure ignition. Therefore, transformer dimensions cannot be reduced significantly.

Other related patents, employing relatively high frequency ignition devices, include U.S. Pat. No. 4,326,493 issued to J. Merrick, and U.S. Pat. No. 4,947,821 issued to M. Somiya. The structure of high frequency ignition devices is complex and supposes use of step up DC to DC converters to reduce time for energy accumulation in inductors and capacitors.

U.S. Pat. No. 4,892,073 issued to N. Yamamoto et al, discloses a conventional ignition system comprising individual ignition coils for each spark plug. As is shown by John B. Heywood in his 'Internal Combustion Engine Fundamentals', McGraw Hill, Inc., 1988, FIG. 9–39, for a conventional coil spark ignition system, an ignition coil in this system is demagnetized in wide range of intensity, that is, the voltage on spark plug electrodes jumps up to 15–20 kV during a few microseconds in a 'pre-break-down' phase but remains respectively low (0.5 kV) in a 'post-break-down' phase, during 1.5–2.0 milliseconds. Because ignition coils with laminated iron cores have more capacity for accumulation of energy in magnetic field than coils with other core materials, they are still commonly used. But use of these laminated cores results in high eddy currents in the 'pre-break-down' phase as the voltage on the secondary winding of the coil corresponds to the high voltage on spark plug electrodes. These eddy currents decelerate the 'pre-break-down' phase and reduce available voltage of an ignition coil. And vice versa, ferrite cores are able to provide an effective jump of voltage in the 'pre-break-down' phase, but they are unable to store comparable quantity of energy in the same volume to efficiently keep ignition process going in the 'post-break-down' phase, so there is still a need for improved disributorless ignition systems, that are free from the disadvantages described above.

SUMMARY OF THE INVENTION

This invention relates to a distributorless ignition system for internal combustion engines and more specifically, to the system, having ignition coils neared to spark plug heads as much as possible or mounted directly thereon.

One of the objects of the present invention is to increase electrical energy which is emitted between spark plug electrodes during each ignition firing and minimize rated power, size and weight of ignition coil means which are disposed on the spark plug heads.

According to the invention, there is provided an ignition system for internal combustion engines with basic ignition coil means, which supplies spark plugs with inductive energy, and trigger ignition coil means, which are neared to or disposed on spark plug heads and adapted for inducing electrical break-down across the electrodes of a spark plug. Both the basic and trigger ignition coil means have primary windings being energized from a direct current source, and secondary windings. The first end of the secondary winding of each trigger ignition coil means is electrically connected to its spark plug and the second end thereof is electrically connected to the secondary winding of the basic ignition coil means. The ignition system is also provided with switching means, driven by control unit for switching current in the primary windings of the basic and trigger ignition coil means. Transient voltage suppression means cuts off transient voltage spikes, that may occur as a result of switching, and protects system components from overvoltage. A varistor as said protective means is provided for the secondary winding of the basic ignition coil means. Unidirectional means connected across the primary winding of the trigger ignition coil means, enhances ignition energy available from the basic ignition coil means.

Further objects and advantages of the invention will be understood from the drawings and description of preferred embodiments of the invention which are set forth below.

BRIEF DESCRIPTION OF THE DRAWINGS

The invention will be elucidated by way of examples with reference to the following drawings, in which.

DESCRIPTION OF THE PREFERRED EMBODIMENTS

Figure 1:
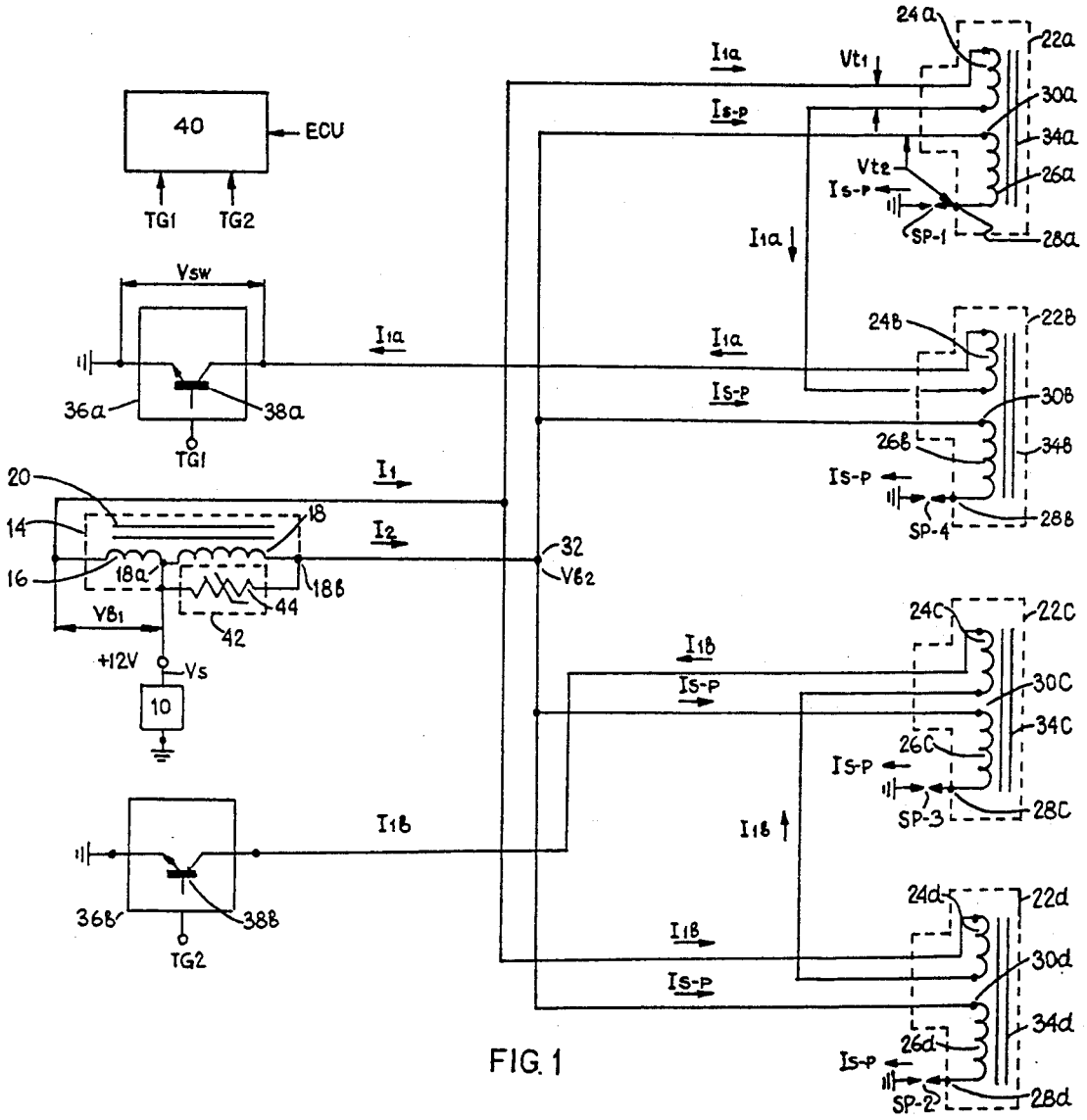
FIG. 1 is a circuit diagram of a distributorless ignition system according to the first embodiment of the present invention.

A distributorless ignition system for an internal combustion engines according to the present invention will be explained in detail with reference to the accompanying drawings. These drawings are given for four cylinder engines, but the invention may be applicable to engines with any quantity of cylinders In FIG. 1 reference numeral 10 designates a 12 V battery as a direct current (DC) source providing a direct current voltage $V_s$; 14 is a basic ignition coil means with a primary winding 16 for energizing said means from the DC source 10 and a secondary winding 18 for providing ignition current for spark plugs SP-1, SP-4, SP-3 and SP-2; the first end of the secondary winding 18 connected to the DC source 10, and the second end of said winding being designated **18*a* and 18*b* correspondingly; 20 is a magnetic core on which said primary 16 and secondary 18 windings are wound. In certain cases the basic ignition coil means 14 can be provided with more than one primary windings for improvement of energy characteristics of said ignition coil means. Also this coil means can be provided with more than one secondary windings as shown herebelow in FIG. 8A. Further numerals 22*a*, 22*b*, 22*c* and 22*d* designate trigger ignition coil means disposed on spark plug heads for providing electrical break-down in spark plug gaps; 24*a*, 24*b*, 24*c* and 24*d* are primary windings of these trigger ignition coil means 22*a*, 22*b*, 22*c* and 22*d* correspondingly, these windings being energized from the DC source 10; whereas numerals 26*a*, 26*b*, 26*c* and 26*d* are assigned to secondary high voltage windings coupled magnetically with the primary windings 24*a*, 24*b*, ends of said secondary windings which are connected electrically to the spark plugs SP-1, SP-4, SP-3 and SP-2 correspondingly; 30*a*, 30*b*, 30*c* and 30*d* are the second ends of said secondary windings which are connected at a common junction 32 to the second end 18*b* of the basic coil means secondary winding 18; numerals 34*a*, 34*b*, 34*c* and 34*d* are used to designate magnetic cores of the trigger ignition coil means on which the primary and secondary windings of said means are wound; 36*a* and 36*b* designate switching means necessary for switching current in the primary windings of the basic and trigger ignition coil means; 38*a* and 38*b* are transistor switches with overvoltage protection means (not shown) which are parts of said switching means; 40 is a control unit, triggering the switching means with signals TG1 and TG2, and being monitored from Engine Computer Unit ECU (not shown). Also shown in FIG. 1 is the first transient voltage suppression means 42 connected across the secondary winding 18 of the basic ignition coil means 14 for cutting off transient voltage spikes, and a varistor 44 which serves as the first transient voltage suppression means 42. Referring again to FIG. 1, a pair of the primary windings 24*a* and 24*b* connected in series to each other is coupled in a series circuit to the switching means 36*a*. Another pair of the primary windings 24*c* and 24*d* connected in series to each other is also coupled in a series circuit to the switching means 36*b*. Each of these formed series circuits is connected to the DC source 10 through the primary winding 16 of the basic ignition coil means 14. Two pairs of the primary windings 24*a*, 24*b* and 24*c*, 24*d*** mentioned above are chosen for ignition strokes in each cylinder to take place both in compression and exhaust phases of cylinder operation. That cuts by half a number of switching means in the ignition system.

Figure 1A:
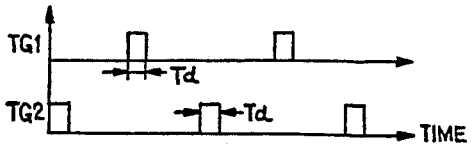
FIG. 1A is a timing diagram for the circuit diagram shown in FIG. 1.
Figure 8A:
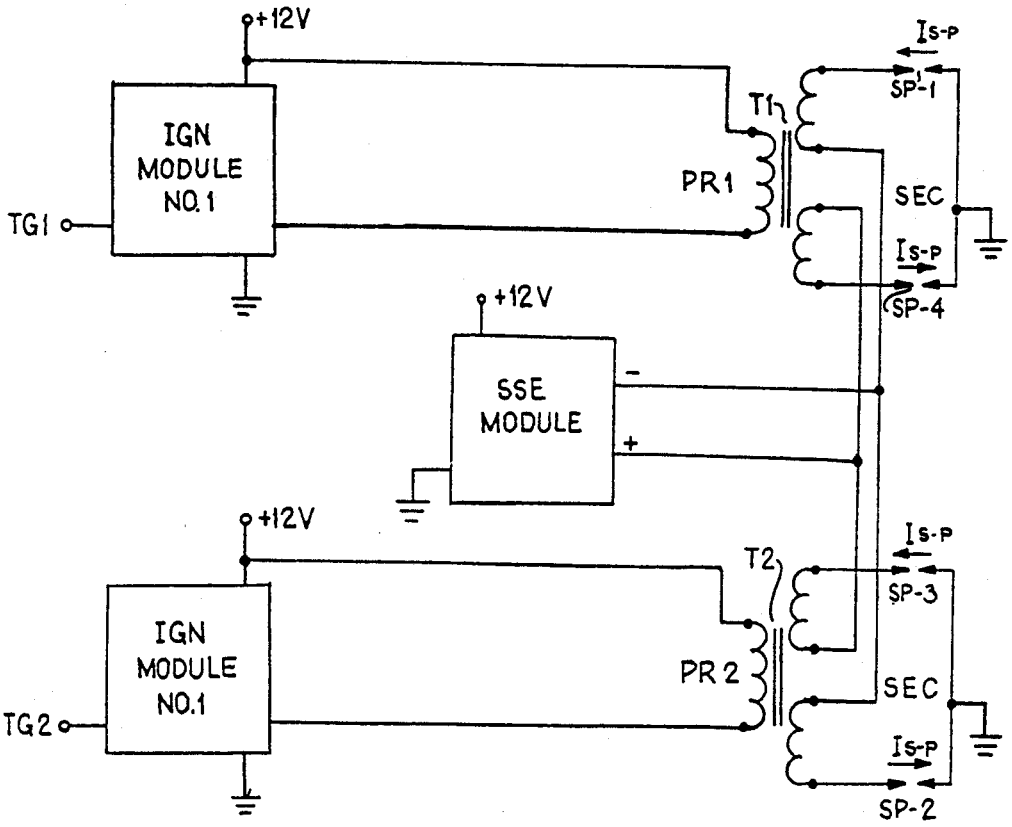
FIG. 8A PRIOR ART
FIG. 8A is a block diagram of a prior art distributorless ignition system.
Figure 8B:
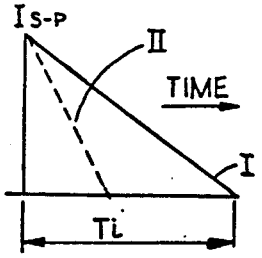
FIG. 8B PRIOR ART
FIG. 8B shows spark plug current in the FIG. 8A block diagram.
Figure 8C:
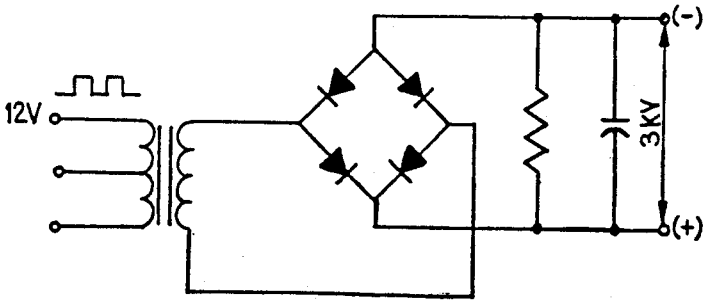
FIG. 8C PRIOR ART
FIG. 8C is a circuit diagram of SSE module shown in FIG. 8A.

Referring now to FIG. 1A and FIG. 8A, one can see there is no difference between the switching means control methods of the present invention and prior art ignition system. Triggering signals TG1 and TG2 shown in FIG. 1A, have duration $T_d$ known as 'dwell-time' which is calculated by ECU. The control unit 40 forms said triggering signals TG1 and TG2.

Figure 1B:
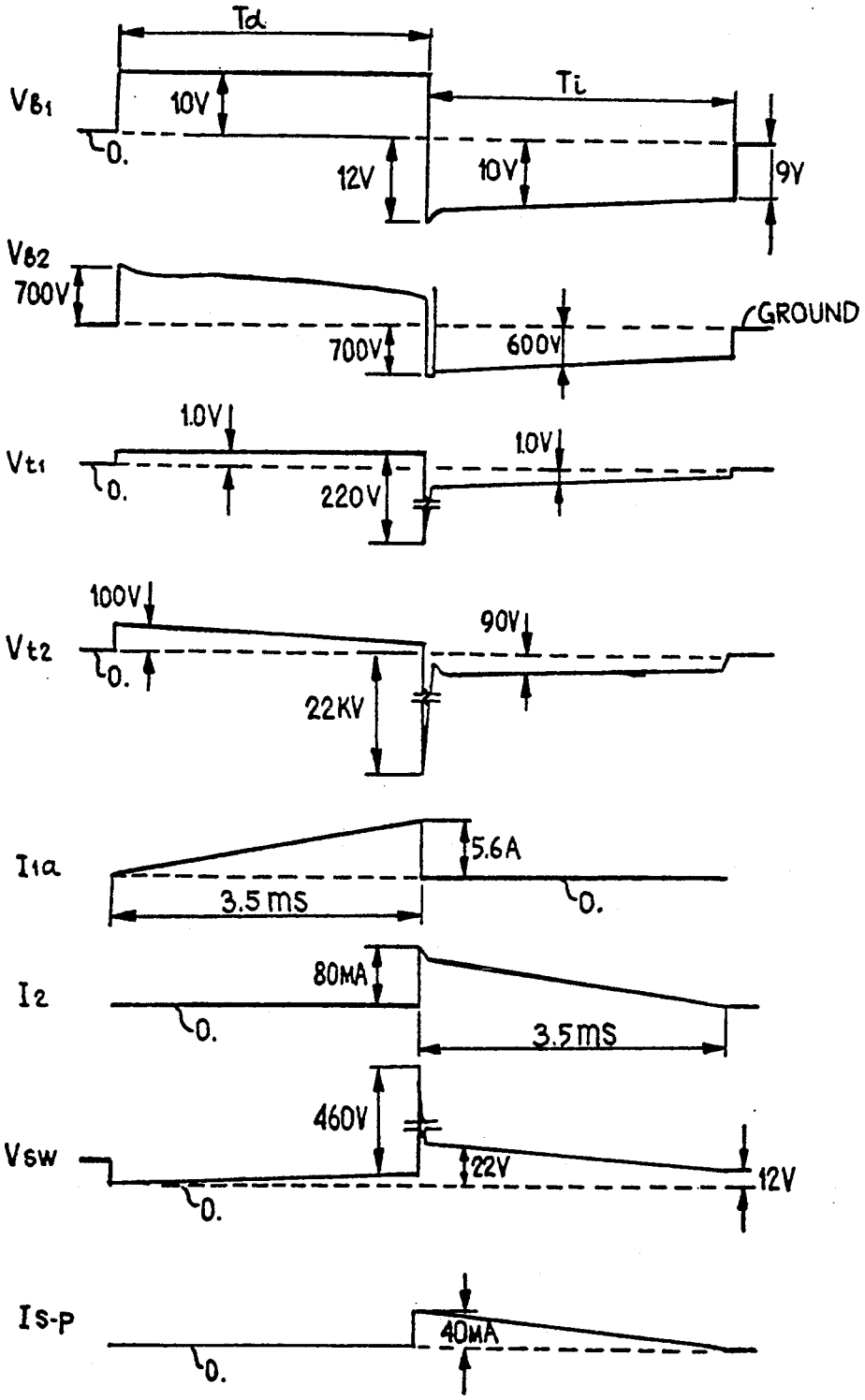
FIG. 1B is a waveform diagram of each part of the circuit diagram in FIG. 1 for explaining the operation of the system.

The manner of the circuit shown in FIG. 1 will be explained referring to the corresponding waveform diagram shown in FIG. 1B. In FIG. 1 and FIG. 1B, $V_{b1}$ and $V_{t1}$ indicate primary voltages and $V_{b2}$ and $V_{t2}$ indicate secondary voltages of the basic ignition coil means 14 and the trigger ignition coil means 22a or 22b correspondingly; $I_{1a}$ is a primary current of said trigger ignition coil means; $I_1$ is a primary current in the basic ignition coil means 14; $I_2$ is an output secondary current of the basic ignition coil means 14; $I_{s-p}$ is the spark plug current in the spark plugs; and $V_{sw}$ represents a voltage across transistor 38a. The current $I_{1b}$ in the circuit shown in FIG. 1 is similar to the current $I_{1a}$. The maximum of the primary current $I_{1a}$ or $I_{1b}$ predetermines duration of the ignition interval $T_i$ and average current in a spark plug in said interval. The dwell time $T_d$, in turn, predetermines the maximum of said primary currents $I_{1a}$ or $I_{1b}$. During this time when, for instance, the transistor switch 38a is on, the current $I_{1a}$ is flowing along the route such as the positive terminal of the battery 10—the primary winding 16—the primary winding 24a—the primary winding 24b—the switching means 36a—the ground. Electromagnetic energy accumulated at the basic 14 and trigger 22a and 22b ignition coil means is distributed among said coil means in proportion to primary inductances thereof. Energy of the trigger ignition coil means 22a and 22b includes energy for charging spark plug electrostatic capacitance, about 15 pF, and residual energy for sufficient initial current in said spark plug in the 'post-break-down' phase. In the preferred embodiment of the invention having a mode in accordance with FIG. 1B, spark plug capacitive energy calculated by 22 kV is about 3.6 mJ and residual magnetic energy accumulated in each trigger ignition coil means, having inductance 0.6 mH, is about 5.8 mJ, that is, total energy accumulated in each trigger ignition coil means is about 9.4 mJ. Energy accumulated in the basic ignition coil means 14, having inductance 6 mH, is about 94 mJ.

When the switching means 38a turns off, spikes of voltage are produced across the windings of the basic and trigger ignition coil means 14, 22a and 22b. The spike of the $V_{b2}$ voltage across the secondary winding 18 of the basic ignition coil means 14 is clamped at level of about 700 V by the varistor 44. Accordingly, the spike of the $V_{b1}$ voltage across the primary winding 16 of said ignition coil means is damped as the primary and secondary windings magnetically coupled to each other and leakage inductances of said windings are respectively low. The following equation is valid after on-off switching:

$$V_s + V_{b1} + 2V_{t1} = V_{sw} \quad (3)$$

This equation shows that the switching means 36a in on-off stage withstands basically the $V_{t1}$ voltages which are produced by the primary windings 24a and 24b of the trigger ignition coil means. The overvoltage protection means (not shown) of the transistor 38a sets the maximum magnitude of the $V_{sw}$ voltage which is about 460 V When this transistor is switching off. Accordingly, the peak voltage of the primary winding 24a or 24b is 220 V; the peak voltage of the secondary winding 26a or 26b of said trigger ignition coil means is 22 kV with the turn ratio $N_t = 100$. The basic ignition coil means in the first embodiment is chosen with the turn ratio $N_b = 70$. The series connection of the windings 24a and 24b provides an equivalence of initial currents in the corresponding spark plugs SP-1 and SP-4. A ferrite core with a gap is used in the trigger switching means; this core does not suffer from losses, being demagnetized rapidly when its magnetic flux collapses. An iron laminated core is used in the basic ignition coil means; this core is demagnetized slowly in all phases of the ignition process shown in FIG. 1B.

In the 'post-break-down' phase during the interval $T_i$, an 26a, 26b, 26c and 26d are assigned to secondary high voltage inductive discharge of the basic 14 and trigger 22a and 22b ignition coil means provides stable ignition currents in the spark plugs SP-1 and SP-4. For most of this interval, the $V_{b2}$ voltage produced by the secondary winding 18 of the basic ignition coil means 14, is less than the cut-off voltage of the varistor 44. The following equation is valid for the interval $T_i$:

$$V_{s-p} = V_{b2} + V_{t2} - V_r \quad (4)$$

$V_r$ indicates a voltage drop across a dummy load (not shown). In the first embodiment the dummy load of about several kOhm causes the voltage drop of about 100–150 V, depending on application of the ignition system. According to equation (4), the $V_{b2}$ voltage is the basic component providing the spark plug holding voltage $V_{s-p}$. In the first embodiment of the invention, the $V_{b2}$ voltage in the 'post-break-down' phase is about 600 V and the cut-off voltage of the varistor 44 is 700 V. The varistor 44 cuts off both positive and negative voltage spikes which may be produced during switching. Also, when a spark plug is disconnected from its trigger ignition coil means, the varistor 44 absorbs excessive energy of the basic ignition coil means 14. For instance, GE-MOV varistors of SM-16 series for automotive application fit the present ignition system very well.

Figure 2:
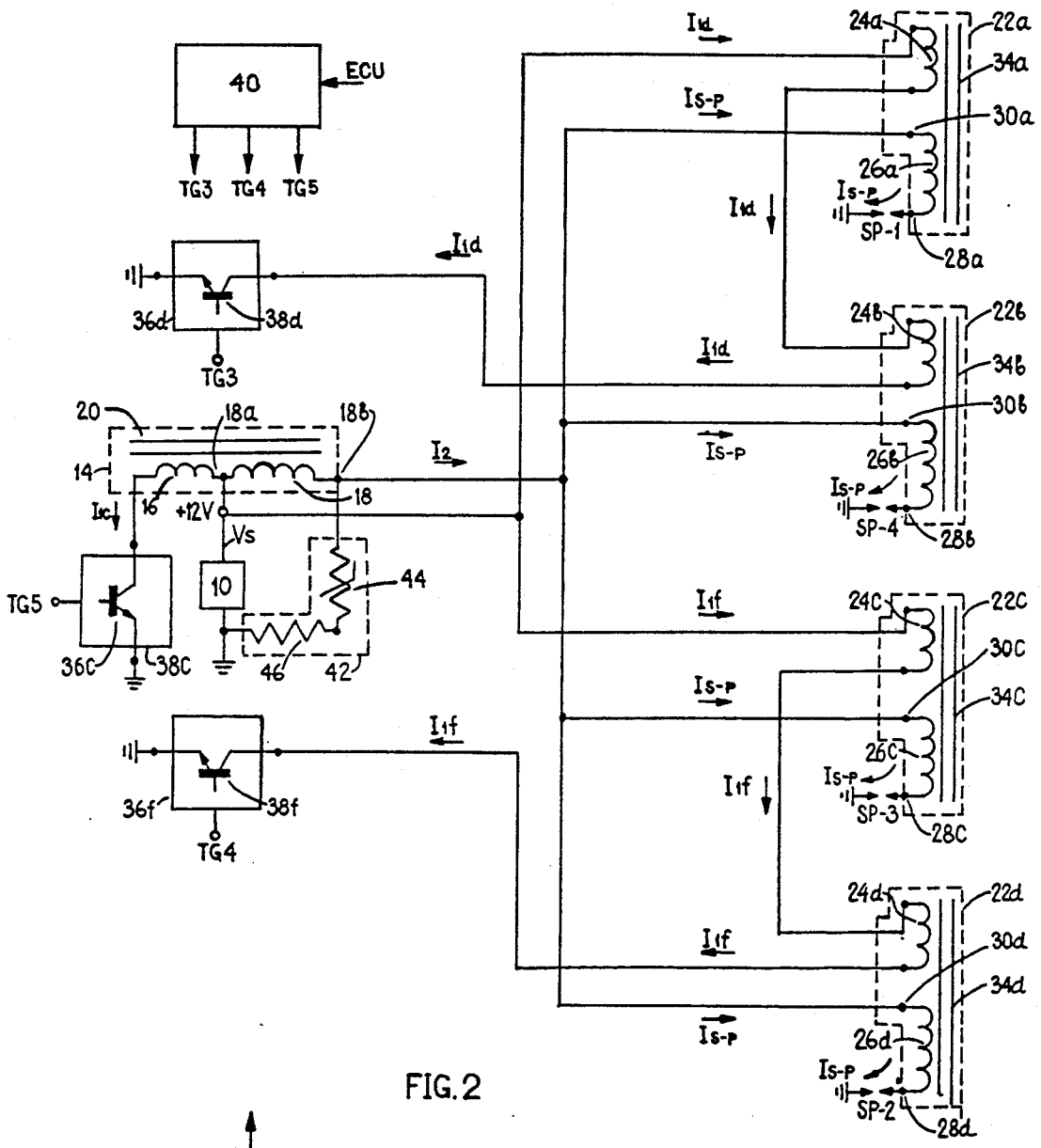
FIG. 2 is a circuit diagram of a distributorless ignition system according to the second embodiment of the present invention.
Figure 2A:
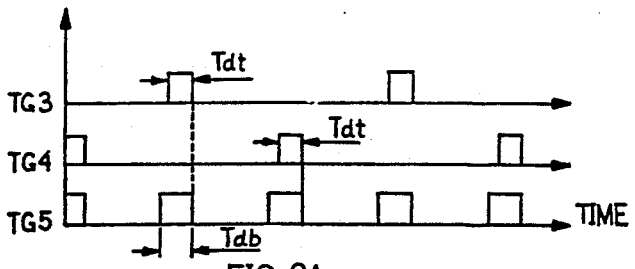
FIG. 2A is a timing diagram for the circuit diagram shown in FIG. 2.

In the second embodiment of the present invention shown in FIG. 2 reference numerals 36d, 36f and 36c designate individual switching means with switching transistors 38d, 38f and 38c which are provided for the pair of the trigger ignition coil means 22a and 22b, for the pair of the trigger ignition coil means 22c and 22d, and for the basic ignition coil means 14 correspondingly. The control unit 40 has three output signals TG3, TG4 and TG5 driving the switching means. Said switching means are locked in when being turned off, but as shown in FIG. 2a, the dwell time $T_{dt}$ of the trigger ignition coil means is less than the dwell time $T_{db}$ of the basic ignition coil means. The dwell time intervals $T_{dt}$ and $T_{db}$ are formed separately by the control unit 40. This reduction of $T_{dt}$ in comparison with $T_{db}$ makes possible the reduction of turns in the trigger ignition coil means. A resistor 46 is connected in series to the varistor 44 for damping oscillations caused by varistor capacitance. In other respects, the manner of the system of FIG. 2 is the same as of the system of FIG. 1. In some cases the second embodiment of the invention may have the advantage over the first embodiment, such as enhanced energy of the basic ignition coil means and reduced cross section area of primary wires leading to the trigger ignition coil means. The average value of the current $I_{1d}$ or $I_{1f}$ in said wires is 5–6 times less than the corresponding average value of the current $I_{1a}$ or $I_{1b}$ in the system of FIG. 1.

Figure 3:
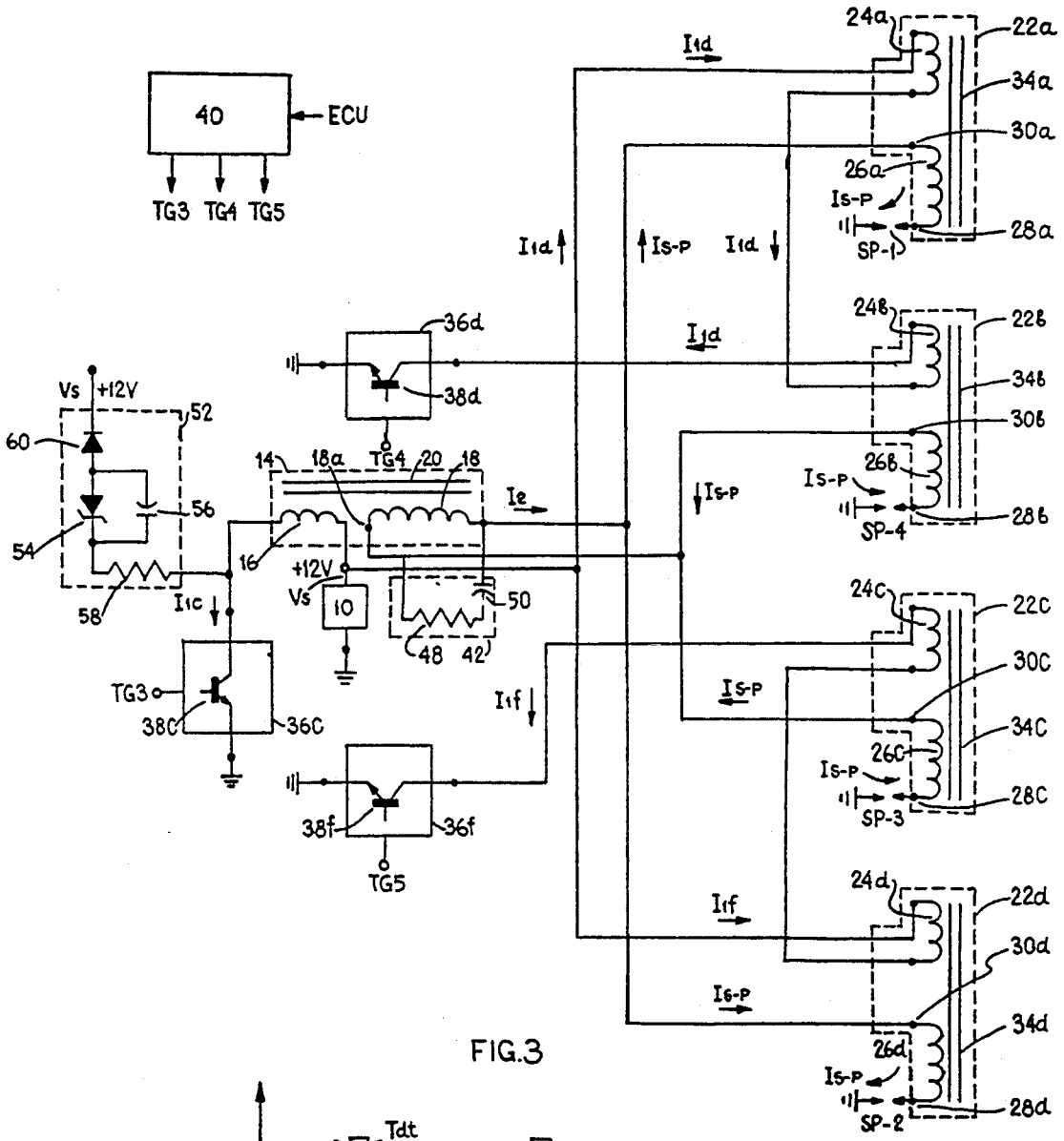
FIG. 3 is a circuit diagram of a distributorless ignition system according to the third embodiment of the present invention.
Figure 3A:
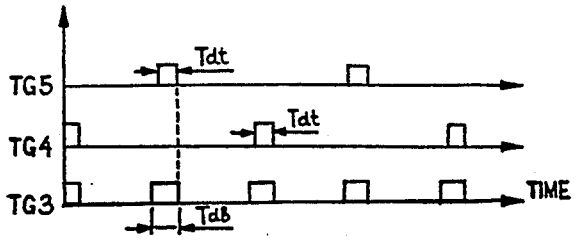
FIG. 3A is a timing diagram for the circuit diagram shown in FIG. 3.

The third embodiment of the present invention shown in FIG. 3 is a variation of the second embodiment shown in FIG. 2. In FIG. 3, the first transient voltage suppression means 42 is provided with a resistor 48 and a capacitor 50. Additionally, there is a second transient voltage suppression means 52 connected to the primary winding 16 of the basic ignition coil means 14. Said second means 52 may include a Zener diode 54 with threshold voltage of about 10 V, a capacitor 56, a series resistor 58 and a diode 60. Accordingly, the transistor 38*c* is of a low voltage type. The second transient voltage suppression means 52 absorbs energy of leakage inductance of the primary winding 16, a portion of energy accumulated in magnetic field of the core 20 that is not drawn out by the trigger ignition coil means, and transient energy of on-off switching. The voltage induced across the secondary winding 18 has a limited amplitude of about 1.4 kV with damped oscillations superposed thereon. The purpose of the first transient voltage suppression means 42 is primarily to suppress the transient voltage across the secondary winding 18 caused by initial spark plug current.

In FIG. 3, the secondary winding 18 of the basic ignition coil means 14 is separated from the DC source 10. Each of the second ends 30*a*, 30*b*, 30*c* and 30*d* of the secondary windings in the trigger ignition coil means 22*a*, 22*b*, 22*c* and 22*d* is connected to the corresponding end 18*a* or 18*b* of the secondary winding 18 of the basic ignition coil means 14. This way said winding is being discharged across two corresponding spark plugs, connected in series through the ground. During ignition interval when, for instance, the transistor 38*d* is switching off, spark plug current $I_{s-p}$ is flowing along the route such as the end 18*b* of the secondary winding 18 of the basic ignition coil means 14—the winding 26*a* of the trigger ignition coil means 22*a*—the spark plug SP-1—the ground—the spark plug SP-4—the winding 26*b* of the trigger ignition coil means 22*b*—the end 18*a* of the secondary winding 18. These corresponding spark plugs are firing by the same current during compression and intake phases. Voltage spikes at the ends 18*a* and 18*b* have different polarities relative to the ground, but the same peak magnitude of about 700 V, as well as spikes at the common junction 32 in the system of FIG. 2. Accordingly, the turn ratio of the basic ignition coil means 14 is doubled in comparison with the same parameter in FIG. 2. In other respects there is no difference in the manners of these two ignition systems.

Figure 4:
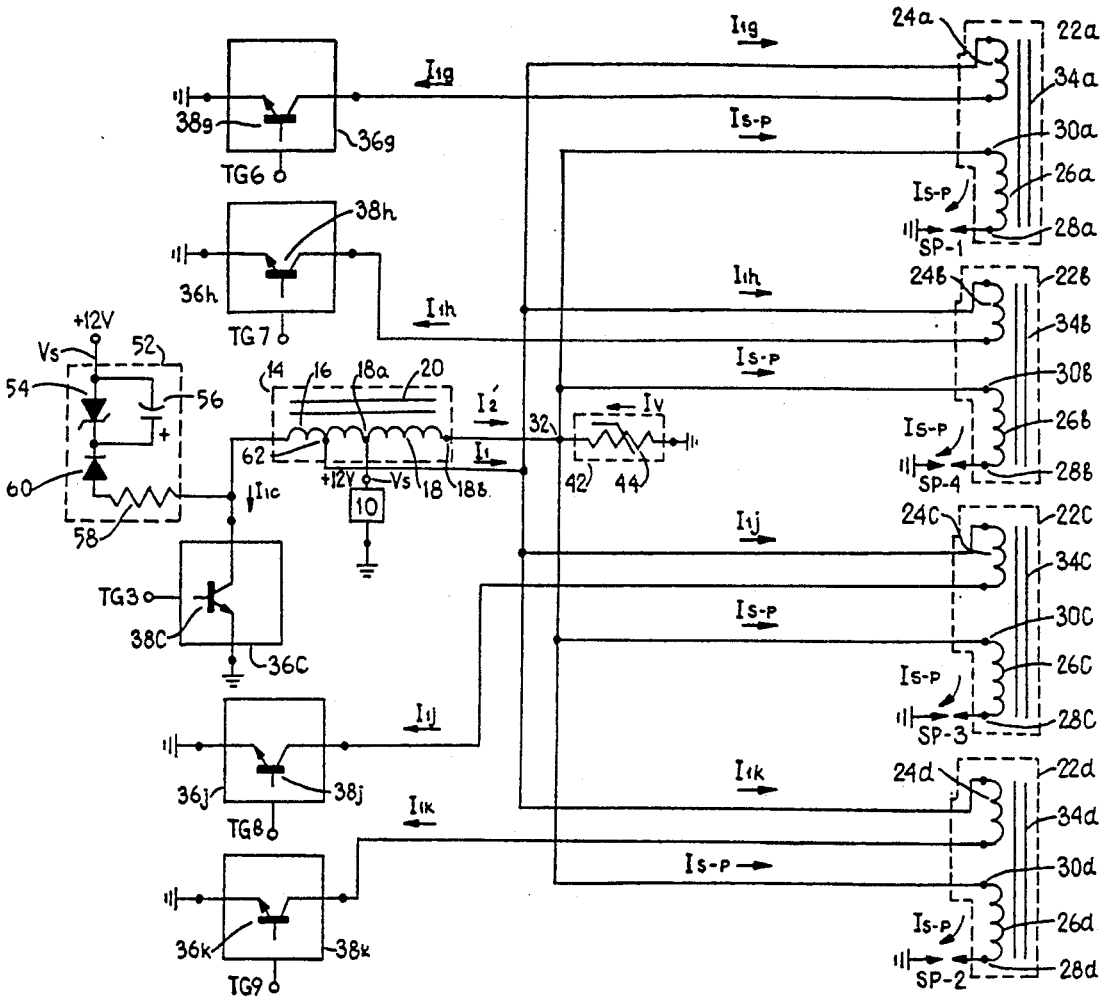
FIG. 4 is a circuit diagram of a distributorless ignition system according to the fourth embodiment of the present invention.
Figure 4A:
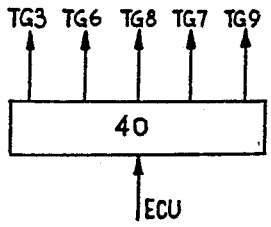
FIG. 4A is a timing diagram for the circuit diagram shown in FIG. 4.
Figure 4A:
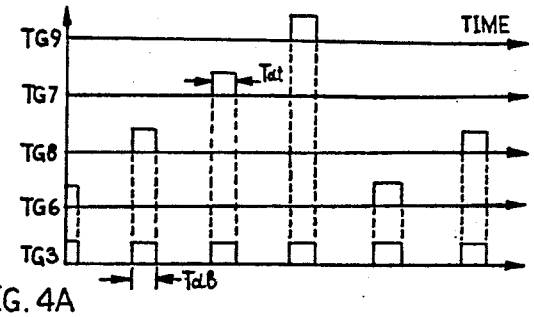

In the fourth embodiment of the present invention shown in FIG. 4, each of the basic and trigger ignition coil means 14, 22*a*, 22*b*, 22*c* and 22*d* is provided with its individual switching means 36*c*, 36*g* , 36*h*, 36*j* and 36*k* correspondingly. Said switching means contain a low voltage transistor 38*c* and high voltage transistors 38*g*, 38*h*, 38*j* and 38*k* for switching currents $I_{1c}$, $I_{1g}$, $I_{1h}$, $I_{1j}$ and $I_{1k}$ correspondingly. The primary winding 16 of the basic ignition coil means 14 is provided with an intermediate tap 62. The primary windings 24*a*, 24*b*, 24*c* and 24*d* of the trigger ignition coil means are connected to the DC source 10 through the part of said winding 16 between this tap 62 and this DC source 10. Therefore, the voltage obtained for energizing the trigger ignition coil means, can be chosen by a turn ratio of the two parts of the winding 16. This voltage is less than and proportional to the battery voltage $V_s$. Thus, the number of turns of trigger ignition coil means windings can be reduced and the dwell time intervals $T_{db}$ and $T_{dt}$ can be equalized that simplifies the control unit 40 (see FIG. 4A). The control unit 40 takes into account that in order to provide a stable energy source for predictable spark break-down, dwell time must be set inversely proportional to the DC source 10 voltage $V_s$.

The dwell time $T_{db}$ of the basic ignition coil means 14 is controlled for variation of the ignition time $T_i$. In the system shown in FIG. 4, the second transient voltage suppression means 52 cuts off superfluous spark plug current when the ignition time $T_i$ increases, for instance, in an idle operation of an engine. Also, when a spark plug is disconnected from its trigger ignition coil means, the second transient voltages suppression means 52 absorbs excessive energy from the basic ignition coil means 14. The peak voltage across the primary winding 16, being transferred to the secondary winding 18, is less than the cut-off voltage of the varistor 44, that is, the basic ignition coil means is not loaded by said varistor. The varistor current $I_v$ is a component of the spark plug current $I_{s-p}$ for about ten microseconds until the secondary current $I'_2$ of the basic ignition coil means 14 increases to the level of the $I_{s-p}$ current. Having the basic ignition coil means with the same rated power as in FIG. 1, 2 or 3, the system shown in FIG. 4 is able to double electrical energy of each useful ignition stroke.

Figure 5:
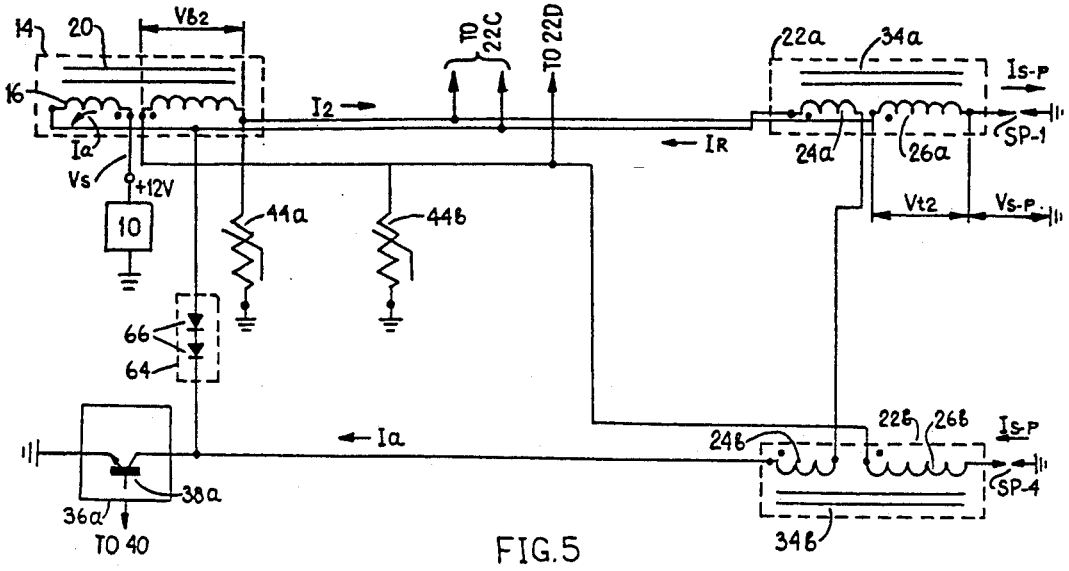
FIG. 5 is a circuit diagram explaining a development of the first embodiment of the present invention.

In the development of the first embodiment of the present invention shown in FIG. 5, the system comprises unidirectional means 64 connected across the pair of the primary windings 24*a* and 24*b* of the respective trigger ignition coil means 22*a* and 22*b*. Said means 64 is intended for shunting said primary windings after electrical break-down in the corresponding spark plugs. In this development, diode means 66, having its cathode connected to the switching means 36*a*, is preferably used as the unidirectional means. Accordingly, said means is also provided for another pair of the respective trigger ignition coil means 22*c* and 22*d* (not shown). In FIG. 5, numerals 44*a* and 44*b* designate varistors as the first transient voltage suppression means connected in series through the ground. The spark plugs SP-1 and SP-4 are also connected in series through the ground, as in the system shown in FIG. 3. The manner of the circuit shown in FIG. 5 will be explained referring to the corresponding equivalent circuit shown in FIG. 7 which is valid after electrical break-down has occured in spark plugs. This circuit comprises pulse current source 68 that substitutes for the secondary winding of the basic ignition coil means 14, the trigger ignition means 22*a* and a switch 70 that substitutes for the unidirectional means 64. After electrical break-down in the spark plug SP-1 the switch 70 turns on, shunting the primary winding 24*a*. Thus, inductance of the secondary winding 26*a* will be neutralized for the current $I_2$ of the pulse current source 68.

Figure 7:
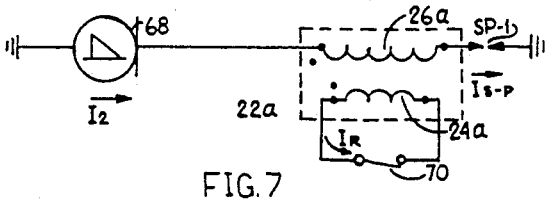
FIG. 7 is an equivalent circuit diagram for interpretation of the circuit diagrams shown in FIG. 5 and FIG. 6.

The manner of the circuit shown in FIG. 5 is approximately the same as of the equivalent circuit shown in FIG. 7. When the transistor switch 38*a* is on, the diode means 66 is directly biased and may be conductive or non-conductive. The voltage across the primary winding 22*a* or 22*b* averages 1 V. When the transistor switch 38*a* turns off, the diode means 66 becomes back biased. The switching means 36*a* overvoltage protection means (not shown) protects the diode means 66 from overvoltage. After electrical break-down in spark plugs, the voltages across the windings of the trigger ignition coil means 22*a* and 22*b* reduce. If the residual magnetic energy is respectively low, said voltages even can change in polarity, since the $V_{b2}$ voltage produced by the secondary winding 18 exceeds the $V_{s-p}$ voltages of the spark plugs SP-1 and SP-4 in the 'post-break-down' phase. Thus, the diode means 66 becomes directly biased again by the reverse current $I_R$. If the turn ratio of the trigger ignition coil means $N_t$ is 100, the drop voltage $V_{t2}$ which is brought in the secondary winding 22a or 22b by the diode means 66 is about 100 V. The $V_{t2}$ voltage is automatically compensated for by increasing of the $V_{b2}$ voltage mentioned above. The following equation (compare with equation 4) is valid after electrical break-down:

$$2V_{s-p}=V_{b2}-2V_{t2}-2V_r \quad (5)$$

According to the equation (5) the cut-off voltage of the varistor 44a or 44b has to be also risen by about 200 V in comparison with the same of the varistor 44 in FIG. 1. When the $I_{s-p}$ current reduces to the level of the magnetization current in the secondary winding 26a and 26b, the diode means 66 becomes non-conductive and the windings 26a and 26b start to induce voltage, supplying energy to the spark plugs SP-1 and SP-4 along with the secondary winding 18 as well as in the system of FIG. 1. The diode means 66 can be also used for the rise of energy accumulated in the basic ignition coil means 14 when brought into conductive mode during the dwell time intervals $T_d$.

Figure 6:
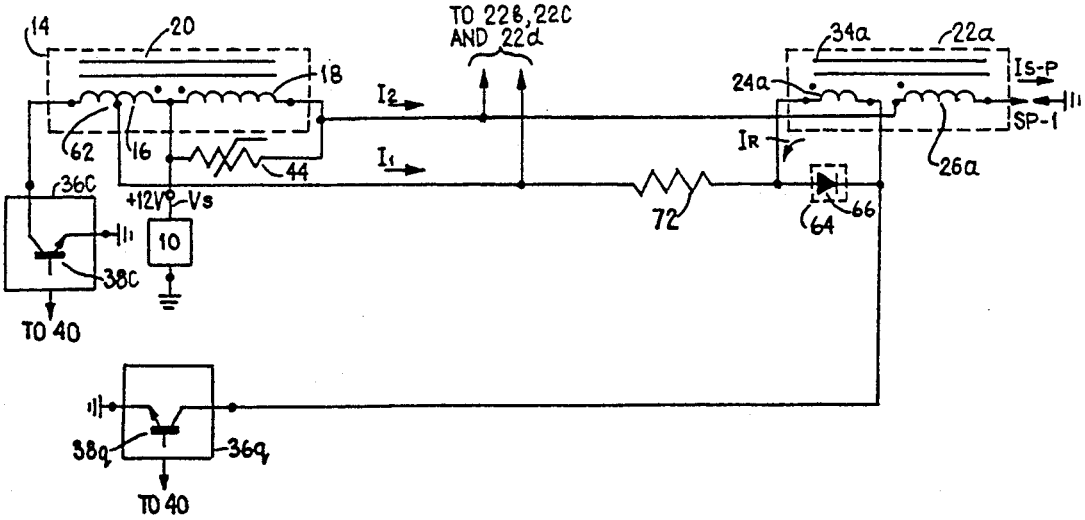
FIG. 6 is a circuit diagram explaining a development of the forth embodiment of the present invention.

In the development of the fourth embodiment of the present invention shown in FIG. 6, the diode means 66 is also used as the unidirectional means 64 connected across the primary windings of the trigger ignition coil means. Numeral 72 designates a limiting resistor or a dummy load of a wire for current limitation in the diode means 66 during the dwell time intervals $T_{dt}$. Accordingly, said means are also provided for other trigger ignition coil means (not shown). The manner of the circuit shown in FIG. 6 is similar to the manner of the circuit shown in FIG. 5 and can be also explained by the equivalent circuit of FIG. 7. In the development of the system shown in FIG. 6, ignition power can be further increased without changes of the power of the trigger ignition coil means and without additional losses in wires leading to the basic ignition coil means 14.

In the developments shown in FIG. 5 and FIG. 6, the trigger ignition coils means may be further miniaturized because there is no need in the residual magnetic energy in said means after electrical break-down. It should be taken into consideration that, as it is known from the above cited Heywood's book, FIG. 9-36, after electrical break-down for a very short interval in so called 'arc phase', the voltage across spark plugs drops down to tens of volts. Therefore, the current $I_2$ in the secondary winding 26a or 26b increases rapidly. In turn, power losses in the varistors 44, 44a and 44b diminish.

In the present invention, energy that can be accumulated in the basic ignition coil with combination of high efficiency of the disclosed system makes possible enhanced energy ignition and can improve the ignition and combustion of air/fuel mixture. In comparison with prior art distributorless ignition system, the disclosed ignition system is cheaper, more efficient and reliable. This system does not have SSE modules which produce high DC voltage applied to spark plugs. About 80–95% of accumulated ignition energy is centralized in the low voltage basic ignition coil, very simple in construction and having a mode of demagnetization with reduced core losses. Cylinder selection is provided by low rated power trigger ignition coils which are neared to spark plug heads or disposed thereon, eliminating high voltage wires that are expensive and not efficient. Energy released as a result of this elimination enhances significantly the ignition energy emitted between spark plug electrodes. And what is more, the disclosed ignition system is compatible with existing engine control systems.

It is understood that various modifications and modes based on the present invention could be made by those skilled in the art without deviating from the spirit or the scope of the disclosed invention . Accordingly, the subject matter sought to be protected hereby should be extended to the subject matter defined in the claims and all equivalents thereof.

I claim:

1. A distributorless ignition system for internal combustion engines utilizing spark plugs comprising:

basic ignition coil means having at least one primary winding, being energized from a direct current source, and at least one secondary winding for providing ignition current for said spark plugs, wherein both said windings are magnetically coupled;

trigger ignition coil means adapted for causing electrical break-down across at least one of spark plugs, said trigger ignition coil means having a primary winding being energized from the direct current source, and a secondary winding with the first end thereof electrically connected to one of said spark plugs, and with the second end thereof electrically coupling this winding in series with the secondary winding of the basic ignition coil means, said primary and secondary windings in said trigger ignition coil means being magnetically coupled with each other;

switching means connected to the primary windings of said basic ignition coil means and said trigger ignition coil means for switching current in the primary windings of the basic and trigger ignition coil means, and a control unit driving the switching means.

2. A distributorless ignition system according to claim 1, wherein the primary winding of each trigger ignition coil means, or a pair of primary windings of the respective trigger ignition coil means connected in series to each other is coupled in a series circuit to the corresponding switching means driven by the control unit; each of this formed series circuits being connected to the direct current source through the primary winding of the basic ignition coil means.

3. A distributorless ignition system according to claim 1, wherein the primary winding of the basic ignition coil means, the primary windings of the trigger ignition coil means, or the respective pair thereof are connected to the direct current source through their individual switching means driven by the control unit.

4. A distributorless ignition system according to claim 3, wherein the primary winding of the basic ignition coil means is provided with an intermediate tap, the primary windings of the trigger ignition coil means or the respective pair thereof being connected to the direct current source through the part of the primary winding between said tap and the direct current source.

5. A distributorless ignition system according to claim 1 comprising the first transient voltage suppression means connected to the secondary winding of the basic ignition coil means.

6. A distributorless ignition system according to claim 1 comprising the second transient voltage suppression means connected to the primary winding of the basic ignition coil means.

7. A distributorless ignition system according to claim 5, wherein said first transient voltage suppression means includes a varistor.

8. A distributorless ignition system according to claim 1 further comprising unidirectional means, each of them being connected across the primary winding of each trigger ignition coil means or the respective pair of the primary windings of the trigger ignition coil means for shunting these windings after electrical break-down in the corresponding spark plugs.

9. A distributorless ignition system according to claim 2 or 4 further comprising diode means connected across the primary winding or the corresponding pair of the primary windings of the trigger ignition coil means, said diode means having its cathode connected to the corresponding switching means.

* * * * *